United States Patent [19]

Takao

[11] Patent Number: 4,677,955

[45] Date of Patent: Jul. 7, 1987

[54] METHOD AND APPARATUS FOR DISCRIMINATING OPERATIVENESS/INOPERATIVENESS OF AN AIR-FUEL RATIO SENSOR

[75] Inventor: Mitsunori Takao, Kariya, Japan

[73] Assignee: Nippondenso Co., Ltd., Kariya, Japan

[21] Appl. No.: 792,929

[22] Filed: Oct. 30, 1985

[30] Foreign Application Priority Data

Nov. 30, 1984 [JP] Japan ..... 59-254431

[51] Int. Cl.[4] ..... F02D 41/22

[52] U.S. Cl. ..... 123/489; 123/440

[58] Field of Search ..... 123/440, 489

[56] References Cited

U.S. PATENT DOCUMENTS 3,916,848 11/1975 Schmidt ..... 123/32

3,938,479 2/1976 Oberstadt ..... 123/489

4,177,787 12/1979 Hattori et al. ..... 123/489 X 4,485,786 12/1984 Kashimura ..... 123/440

4,505,246 3/1985 Nakajima et al. ..... 123/489

4,512,313 4/1985 Tsuchida et al. ..... 123/489 X

*Primary Examiner*—Tony M. Argenbright

*Attorney, Agent, or Firm*—Cushman, Darby & Cushman

[57] ABSTRACT

In an air-fuel ratio feedback control system for an engine having an air-fuel ratio sensor, operativeness/inoperativeness of the air-fuel ratio sensor is discriminated. An output signal of the air-fuel ratio sensor is compared and a difference thereof from a reference level is integrated for a predetermined internal of time. Integration value is compared with a discrimination reference so that a feedback control is disabled when the integration value does not attain the discrimination reference indicating inoperativeness of the air-fuel ratio sensor.

9 Claims, 9 Drawing Figures

METHOD AND APPARATUS FOR DISCRIMINATING OPERATIVENESS/INOPERATIVENESS OF AN AIR-FUEL RATIO SENSOR

BACKGROUND OF THE INVENTION

The present invention relates to a method and apparatus for discriminating operativeness/inoperativeness of an air-fuel ratio sensor which is provided in an exhaust passage of an internal combustion engine to detect an air-fuel ratio of mixture supplied to the internal combustion engine.

A feedback control system for an internal combustion engine which feedback-controls an air-fuel ratio of mixture to be supplied to the engine in response to the exhaust from the internal combustion engine has been employed to improve operating conditions of the internal combustion engine. The control system has an oxygen concentration sensor provided in the exhaust passage of the internal combustion engine as an air-fuel ratio sensor to detect the air-fuel ratio of mixture supplied to the engine and feedback controls quantity of fuel to be supplied to the internal combustion engine in response to the output signal of the oxygen concentration sensor. In other words, the system performs a feedback control to maintain the air-fuel ratio of mixture to be supplied to the combustion engine at a predetermined ratio by increasing and decreasing the quantity of fuel when the air-fuel ratio is above (lean) and below (rich) the predetermined ratio, respectively.

The control system, however, has not been satisfactory. When the oxygen concentration sensor is inoperative because of failure or malfunction thereof, but the air-fuel ratio of mixture to the internal combustion engine is still controlled in response to the output signal thereof, the air-fuel ratio of mixture is controlled to an excessively rich or lean side based on this erroneous output signal, thus deteriorating operating characteristics of the internal combustion engine. In addition, since the oxygen concentration sensor is inoperative or not activated sufficiently unless maintained above a high temperature, accurate air-fuel ratio feedback control cannot be performed without detecting operativeness-/inoperativeness of the sensor.

There have been suggestions to discriminate operativeness/inoperativeness of the oxygen concentration sensor, as disclosed in U.S. Pat. No. 3,916,848, in which an output signal of the oxygen concentration sensor is compared with a predetermined signal level and the oxygen concentration sensor is discriminated to be inoperative when the oxygen concentration sensor does not change the output signal across the predetermined signal level within a predetermined interval of time.

This suggested operativeness/inoperativeness discrimination system, however, is not satisfactory. The conditions under which an air-fuel ratio detecting system, including the oxygen concentration sensor, fails to operate properly cannot accurately be predicted. Even if the oxygen concentration sensor changes the output signal across the predetermined signal level within the predetermined interval of time, the oxygen concentration sensor is not sufficiently operative for detecting the air-fuel ratio, when the sensor malfunctions so that the sensor output signal changes only slightly across the predetermined signal level.

SUMMARY OF THE INVENTION

It is an object of the present invention to provide a method and apparatus for discriminating operativeness-/inoperativeness of an air-fuel ratio sensor, which apparatus is capable of more accurately discriminating the operativeness/inoperativeness of the air-fuel ratio sensor in-respective of the variety of failure or malfunction of the air-fuel ratio sensor and associated electronic circuits, that is, even if the failure or malfunction causes the air-fuel ratio sensor to produce the output signal changes across the predetermined signal level within the predetermined interval of time.

The present invention is characterized by an apparatus for discriminating operativeness/inoperativeness of an air-fuel ratio sensor for an internal combustion engine comprising:

- output detecting means for detecting the output signal of the air-fuel ratio sensor;
- difference calculation means for calculating a difference between the output signal of the output detecting means and a predetermined signal level;
- integration means for integrating, for a predetermined interval of time, a calculation result of the difference calculation means; and
- operativeness/inoperativeness discrimination means for discriminating operativeness/inoperativeness of the air-fuel ratio sensor by comparing an integration result of the integration means with a discrimination reference value.

DETAILED DESCRIPTION OF THE PREFERRED EMBODIMENT

Figure 1:
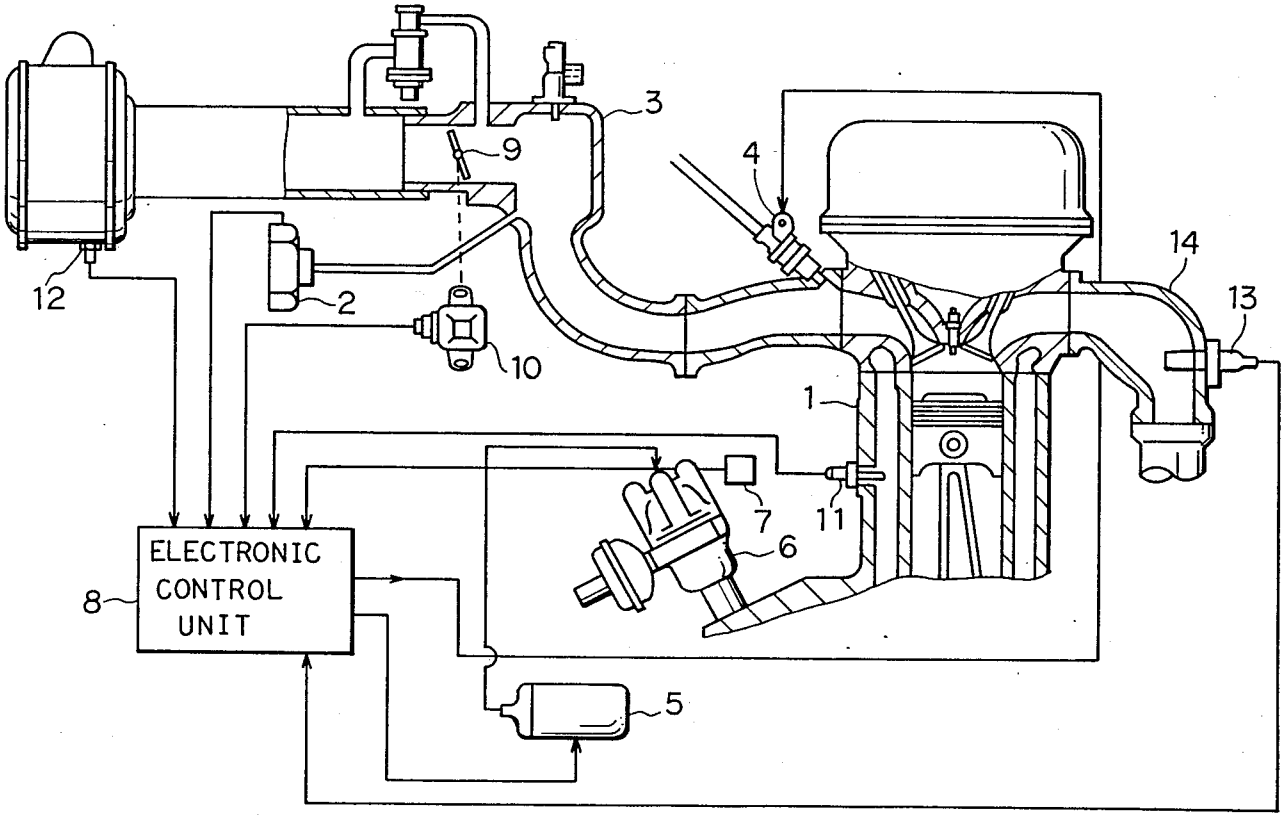
FIG. 1 is a schematic diagram illustrating an internal combustion engine and an air-fuel ratio feedback control system to which the present invention is applied.

FIG. 1 illustrates a schematic structural diagram of an internal combustion engine to which an air-fuel ratio feedback control system having an air-fuel ratio sensor operativeness/inoperativeness discriminating apparatus is mounted. Numeral 1 designates a cylinder of the internal combustion engine, and 2 designates an intake pressure sensor for detecting intake air pressure in an intake manifold 3 connected with the cylinder 1. The pressure sensor 2 comprises a semiconductor type pressure sensor. Numeral 4 designates an electromagnetically-operated fuel injector provided in the vicinity of each intake port of the intake manifold 3, 5 an ignition coil which is a part of an igniter, and 6 a distributor connected to the ignition coil 5. The distributor 6 has a rotor driven at a one-half speed of the rotational speed of an engine crankshaft and is provided with a rotation sensor 7 which provides rotational speed signal and cylinder discrimination signals. Numeral 9 designates a throttle valve, 10 a throttle position sensor for detecting the opening degree of the throttle valve 9, 11 a thermistor-type coolant temperature sensor for detecting the coolant temperature of the engine, 12 an intake air temperature sensor for detecting temperature of the intake air, and 13 an oxygen concentration sensor provided in an exhaust manifold 14 as an air-fuel ratio sensor. The oxygen concentration sensor 13 detects the air-fuel ratio of mixture supplied to the engine from the oxygen concentration in the exhaust gas and provides, when operative, an air-fuel ratio output signal which is about 1 volt and 0.1 volt in amplitude when the detected air-fuel ratio is richer and learner than the stoichiometric air-fuel ratio, respectively.

Numeral 8 designates an electronic control unit comprising a microcomputer for feedback-controlling quantity of injected fuel for the internal combustion engine in response to the detected air-fuel ratio and for discriminating operativeness/inoperativeness of the oxygen sensor. The control unit 8 receives detection signals from the intake air pressure sensor 2, rotation sensor 7, throttle position sensor 10, coolant temperature sensor 11, intake air temperature sensor 12 and oxygen concentration sensor 13 to calculate therefrom quantity of fuel to be injected so that opening interval of the fuel injector 4 is controlled and the air-fuel ratio of mixture to the engine is feedback-controlled to a desired ratio, the stoichiometric ratio for instance.

Figure 2:
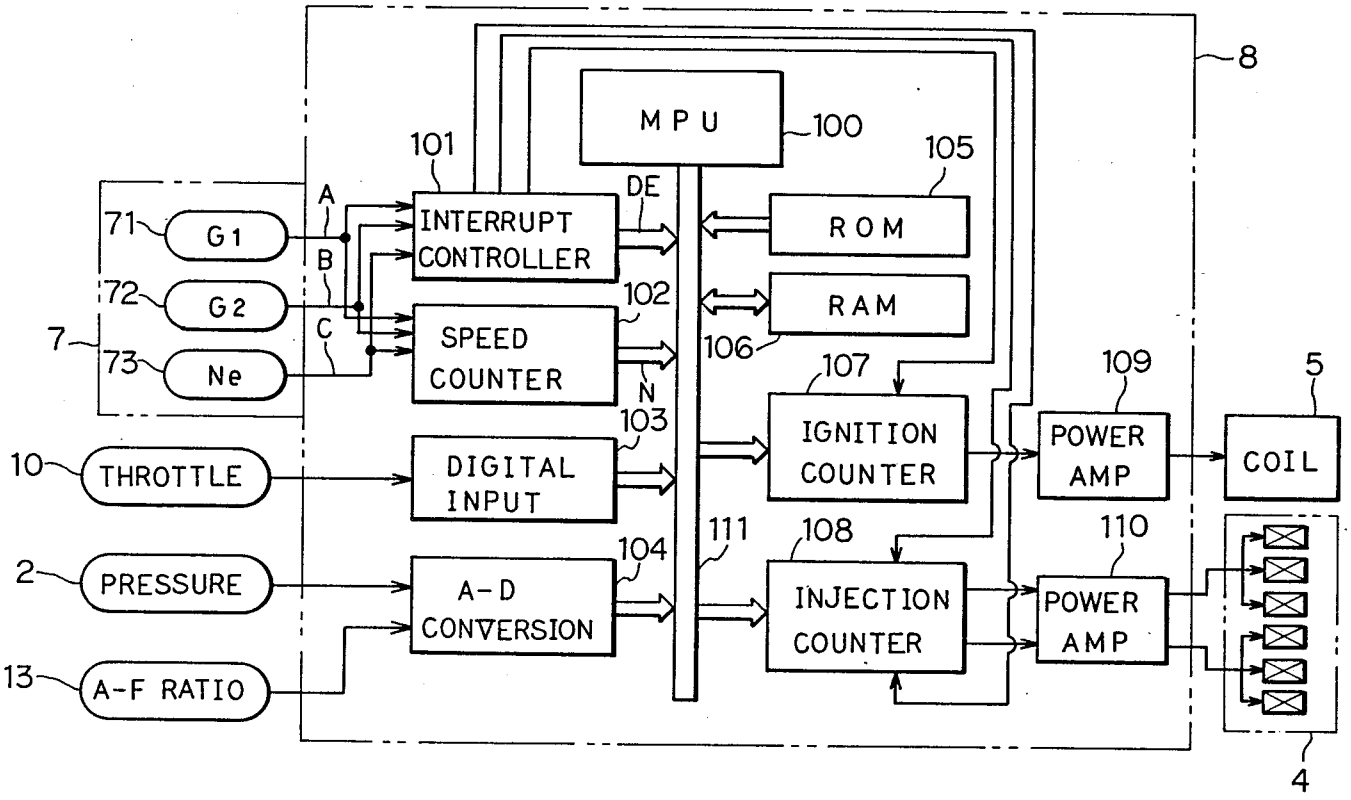
FIG. 2 is a block diagram illustrating in detail a control unit shown in FIG. 1.

FIG. 2 illustrates a block diagram of the control unit 8 and associated sensors and circuits. Numeral 100 designates a MPU (microprocessor unit) which performs calculation processes based on a stored program, 101 an interrupt controller for applying interrupt signals to the MPU 100, 102 a counter for counting rotation signals from the rotation sensor 7 to calculate rotational speed of the engine, 103 a digital input port for receiving detection signal from the throttle position sensor 10, and 104 an A/D converter for converting detection signals from the intake air pressure sensor 2 and oxygen concentration sensor 13 to respective digital signals. Numeral 105 designates a ROM (read only memory) in which processing program for the MPU 100 and mapped data to be used in the calculation are primarily stored, and 106 a RAM (random access memory) which maintains stored content. Numeral 107 designates an output counter including a register for producing ignition timing control signals. The counter 107 receives the ignition timing data calculated by the MPU 100 and produces the ignition timing control signal in relation to the crank angular position. Numeral 108 designates an output counter including a register for producing a fuel injection control signal. The counter 108 receives fuel injection quantity data from the MPU 100 and produces fuel injection quantity control signal which controls the opening interval the fuel injector 4. The control signals produced from the output counters 107 and 108 are applied to the ignition coil 5 and the fuel injector 4 of each cylinder through the power amplifiers 109 and 110, respectively. In the control unit 8, the MPU 100, interrupt controller 101, speed counter 102, digital input port 103, A/D converter 104, ROM 105, RAM 106, and ignition and ingection counters 107 and 108 are connected to a common bus 111 through which data is transferred under command from the MPU 100.

The rotation sensor 7 comprises three sensors 71,72 and 73. As shown by a timing chart (a) in FIG. 3, the first rotation sensor 71 produces an angular signal A at a predetermined angle before the crank angle 0° in each rotation of the distributor 6 or in every two rotations (720°) of the crankshaft. The second rotation sensor 72 produces, as shown by (B) in FIG. 3, an angular signal B at the predetermined angle before the crank angle 360° in every two rotations of the crankshaft. The third rotation sensor 73 produces, as shown by (C) in FIG. 3, equi-angularly spaced angular signals C, the number of which is equal to the number of cylinders of the engine in every rotation of the crankshaft. In the case of 6-cylinder engine, six angular signals C are produced at every 60° angular rotation of the crankshaft starting from the crank angle 0°.

Figure 3:
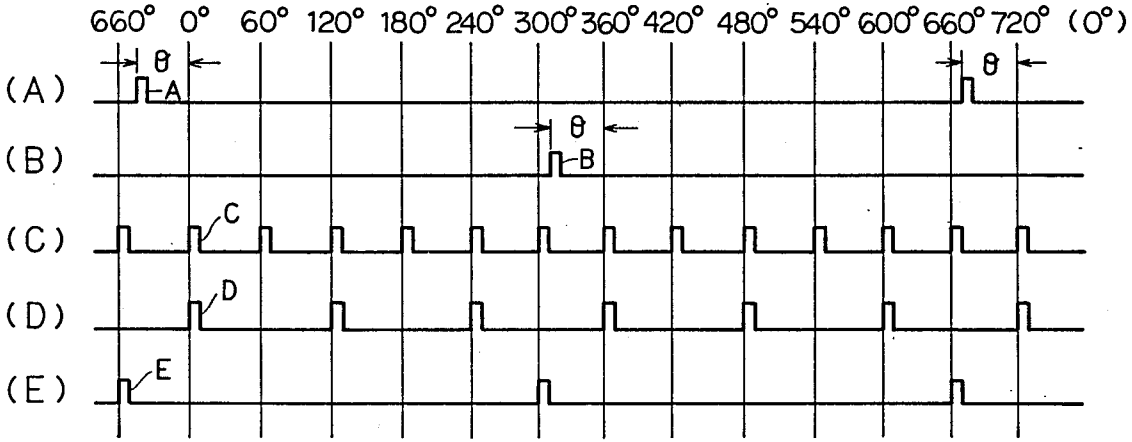
FIGS. 3(A–E) show a timing chart illustrating outputs of rotation sensor and an interrupt controller shown in FIG. 2.

The interrupt controller 101 receives these angular signals from the rotation sensor 7 and ½-divides the third angular signal C from the third rotation sensor 73 in frequency so that the frequency-divided signal is applied as the interrupt request signal D shown by (D) in FIG. 3 to the MPU 100 immediately after the angular signal A from the first rotation sensor 71 is produced. The MPU 100 starts calculation routine (not shown) for the ignition timing control in response to the interrupt request signal D. The interrupt controller 101 further 1/6-divides the angular signal C from the third rotation sensor 73 in frequency so that the frequency-divided signal E shown by (E) in FIG. 3 is applied to the MPU 100 as an interrupt request signal E at every sixth angular signal C after the angular signals A and B from the first and second angular sensors 71 and 72 are produced, at every 360° angular rotation of the crankshaft starting from the crank angle 300°. The interrupt request signal E commands the MPU 100 to start fuel injection quantity calculation.

Air-fuel ratio feedback control responsive to the output signal of the oxygen sensor 13 is well known. Therefore, no detailed description will be made.

However, it must be pointed out here for the better understanding of the following description that the output signal of the oxygen concentration sensor 13 changes cyclically at about 1 Hz across a predetermined signal level when the feedback control is performed with the oxygen concentration sensor 13 operating normally, whereas the output signal of the same changes only slightly across the predetermined signal level or may not even attain the predetermined level when the oxygen concentration sensor 13 is insufficiently heated and inoperative.

An air-fuel ratio sensor operativeness/inoperativeness discrimination routine performed by the MPU 100 in this embodiment will be described next.

Figure 4:
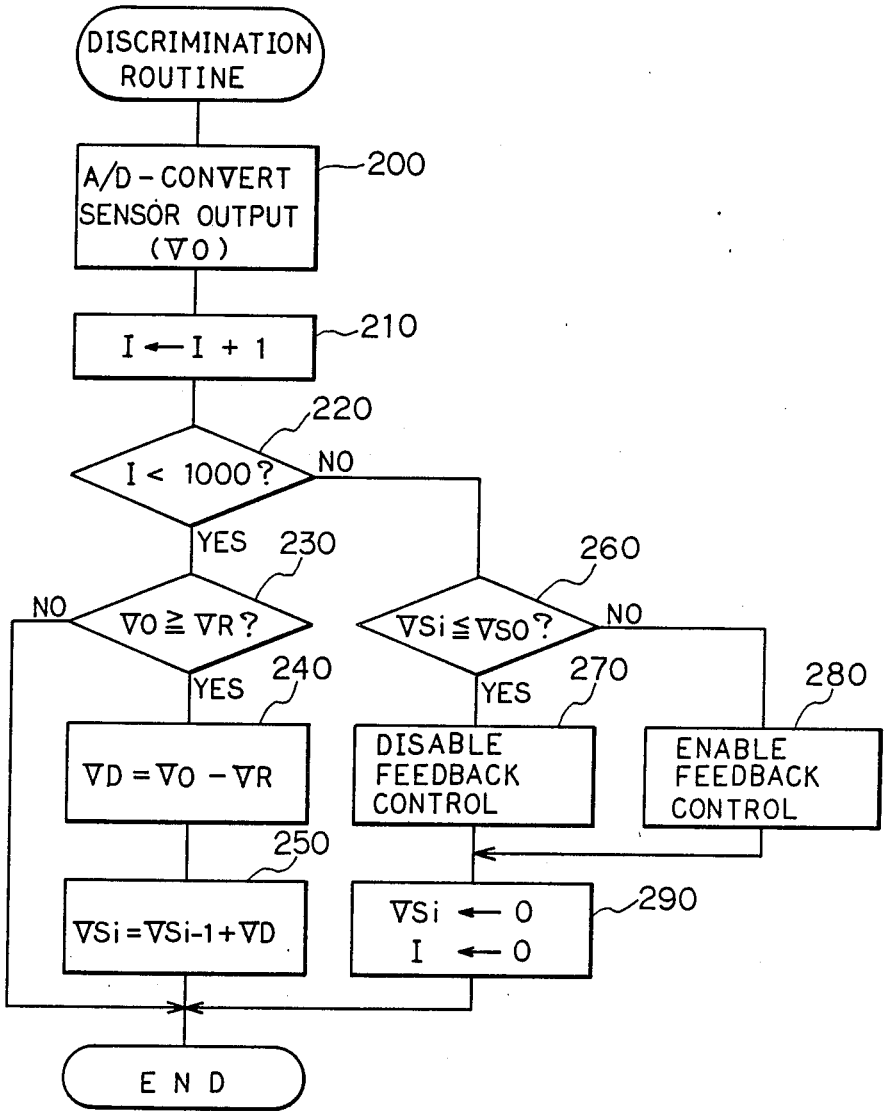
FIG. 4 is a flowchart illustrating a control program performed by a control unit shown in FIG. 2.

FIG. 4 illustrates a flowchart of the air-fuel ratio sensor operativeness/inoperativeness discrimination routine. This routine is an interrupt routine performed by the MPU 100 at every predetermined interval, 5 ms for example.

When the MPU 100 proceeds to this routine, a step 200 is performed in which the output signal VO of the oxygen concentration sensor 13 is converted into a digital signal to be applied to the control unit 8. Steps 210 and 220 are provided to measure an integration time interval. When the power supply is turned on to crank the internal combustion engine, a variable I is reset to zero. Thereafter, the incrementing process step (step 210) is performed to increment the variable I. It is discriminated at the step 220 whether the variable I has yet attained 1000. In other words, since this routine is performed every 5 ms and the variable I is incremented each time, it requires 5 seconds for the content of the variable I to attain 1000. The variable I means the integration time interval. Steps 230 through 250 are performed if the variable I is smaller than 1000, meaning that it is still within the integration time interval, whereas steps 260 through 290 are performed if the variable I is larger than or equal to 1000, meaning that the integration time interval has passed.

It is first discriminated at the step 230 whether the output signal VO of the oxygen concentration sensor 13 applied at the step 200 is above or below the predetermined signal level VR, which corresponds to the stoichiometric air-fuel ratio. If VO is smaller than VR, indicating that the detected air-fuel ratio is lean, the following integration process is not performed but this routine is terminated. The predetermined signal level VR is set to a value which is not attained when the oxygen concentration sensor 13 is inoperative, and is selected between 0.4–0.6 volts. If VO is larger than or equal to VR, indicating that the detected air-fuel ratio is rich, the difference VD=VO−VR between the predetermined signal level VR and the output signal VO is calculated at the step 240 for the following integration process. At the next step 250, integration is performed and the integration value VSi is stored in a predetermined address of the RAM 106. Here it should be understood that variables VSi and VSi−1 used for the integration have been already cleared by the initial setting in the same manner as the variable I has been when the power supply is turned on for cranking the internal combustion engine and that VSi−1 is the variable which is the calculation result VSi obtained when this step is performed previously. Therefore, when this step 250 is processed next time, the presently calculated result VSi will be stored as the variable VSi−1. Thus, integration is performed by adding the difference VD to the previous value.

Processes to be performed when the integration time interval 5 seconds passes, i.e. the variable I reaches 1000, are described next. At the step 260, the integration value VSi stored in the predetermined address at the step 250 is compared with the discrimination value VSO. This discrimination value VSO is determined from a value which will be obtained by integrating, for 5 seconds, the output signal VO in excess of the predetermined level VR on an assumption that the output signal VO of the oxygen concentration sensor is normal and the internal combustion engine is feedback-controlled. As a result of the comparison of the integration value VSi for the predetermined time internal, 5 seconds, with the discrimination reference value VSO, the steps 270 and 280 are performed if VSi is smaller than or equal to VSO, and VSi is larger than VSO, respectively.

With VSi being smaller than or equal to VSO indicating that the output signal of the oxygen concentration sensor 13 does not change sufficiently, it will be discriminated that the oxygen concentration sensor 13 is not activated yet or a certain malfunction is caused. Under this condition, the air-fuel ratio feedback control is disabled at the step 270, since feedback-controlling the air-fuel ratio of mixture to the internal combustion engine in response to the output signal of the oxygen concentration sensor 13 would cause the air-fuel ratio of the internal combustion engine to deviate from the stoichiometric ratio.

On the other hand, with VSi being larger than VSO, it is discriminated that the oxygen concentration sensor 13 and associated circuits are operating properly and at the step 280 the air-fuel ratio feedback control is enabled. At the step 290 performed after these processes, the variables I and VSi are reset to zero to terminate this routine so that the integration value VSi of the output of the oxygen concentration sensor 13 is calculated again.

Figure 5:
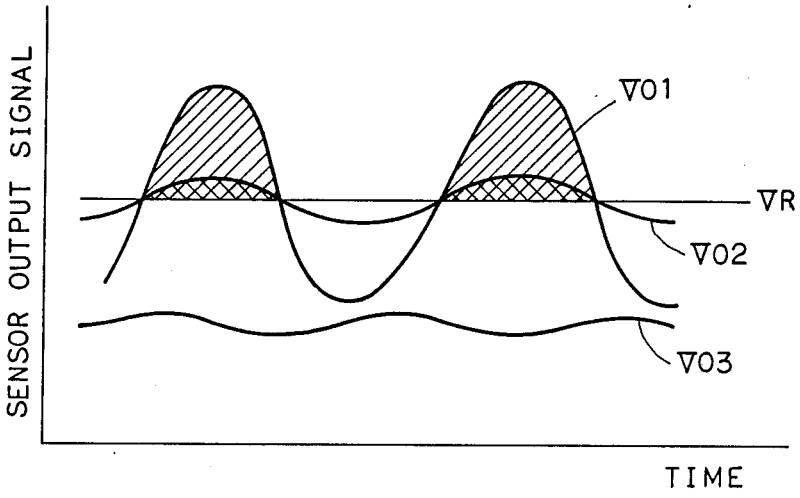
FIG. 5 is a chart illustrating an output signal of an air-fuel ratio sensor which is processed by the control program of FIG. 4.

It would be understood from the foregoing description that, as shown in FIG. 5, the integration value (single-hatched region in the figure) of the output signal VO1 of the oxygen concentration sensor operating properly with respect to the predetermined signal level VR is sufficiently large. Provided that the oxygen concentration sensor 13 is inoperative, the integration value (double-hatched region in the figure) is not sufficiently large to disable the feedback control instanteneously even if the output signal VO2 is produced in such a manner that the average values of the period and output signal of the oxygen concentration sensor 13 is uniform. This is also true when the oxygen concentration sensor 13 only produces the output signal VO3 which does not attain the predetermined signal level VR.

As described hereinabove, the air-fuel ratio sensor operativeness/inoperativeness discrimination apparatus according to the embodiment can accurately discriminate operativeness/inoperativeness thereof and certain malfunctions of the signal processing circuit for the sensor output. In addition, since the control for the internal combustion engine is switched from the feedback control to the open-loop control in accordance with the discrimination result, operating conditions of the internal combustion engine is not deteriorated and stabilized air-fuel ratio feedback control is enabled. Further, since the operativeness/inoperativeness of the oxygen concentration sensor 13 is discriminated in terms of the integration value, accurate operativeness-/inoperativeness discrimination is enabled even if the oxygen concentration sensor output voltage momentarily jumps or fluctuates periodically.

It should be noted, although the lowest limit of the integration value VSi of the oxygen concentration sensor 13 operating properly is selected as the discrimination reference value VSO in the above-described embodiment, the highest limit thereof may be selected as the discrimination value VSO so that the operativeness-/inoperativeness of the oxygen concentration sensor 13 is discriminated and the air-fuel ratio feedback control is disabled when the integration value VSi exceeds the highest limit. This is advantageous when the oxygen concentration sensor 13 keeps producing the output signal VO above the reference level VR because of certain malfunctions. In addition, both the highest limit and lowest limit may be selected as the discrimination reference values so that the operativeness of the oxygen concentration sensor 13 is discriminated only when both conditions are satisfied.

Further, the predetermined signal level VR and the discrimination reference value VSO in the above-described embodiment may be varied in accordance with operating condition of the internal combustion engine such as engine idling conditions, engine load conditions or cold engine conditions. In this instance, the borderline for discriminating the intergration value VSi can be more precisely determined and a more accurate operativeness/inoperativeness discrimination will be enabled.

What I claim is:

1. An apparatus for discriminating operativeness-/inoperativeness of an air-fuel ratio sensor which produces an output signal indicative of air-fuel ratio, provided in an exhaust passage of an internal combustion engine so that an air-fuel ratio of mixture to said engine is feedback-controlled in response to an output signal of said air-fuel ratio sensor, said apparatus comprising:

means for comparing the output signal of said air-fuel ratio sensor with a predetermined reference level;

means for calculating a difference between the output signal of said air-fuel ratio sensor and said predetermined reference level;

means for integrating, for a predetermined interval of time, the difference calculated by said calculating means to produce an integration value;

means for comparing the integration value produced by said integrating means with a predetermined discrimination reference, so that operativeness-/inoperativeness of said air-fuel ratio sensor is discriminated in response to a comparison output of said comparing means; and means for enabling said difference calculating means to calculate said difference in response to an output of said output signal comparing means indicative of an attainment of the output signal of said air-fuel ratio sensor at the predetermined reference level.

2. An apparatus according to claim 1 further comprising means for disabling feedback control of the air-fuel ratio of mixture in response to the comparison output indicative of the inoperativeness of said air-fuel ratio sensor.

3. An apparatus according to claim 1, wherein said predetermined interval of time is longer than a cycle period in which said air-fuel ratio sensor, when operative, changes the output signal thereof across the predetermined reference level.

4. A method for discriminating operativeness/inoperativeness of an air-fuel ratio sensor which produces an output signal indicative of feedback control, provided in an exhaust passage of an internal combustion engine so that an air-fuel ratio of mixture to said engine is feedback-controlled in response to an output signal of said air-fuel ratio sensor, said method comprising the steps of:

comparing the output signal of said air-fuel ratio sensor with a predetermined reference level;

calculating a difference between the output signal of said air-fuel ratio sensor and the predetermined reference level;

integrating, for a predetermined interval of time, the difference calculated by said calculating step;

comparing an integration value produced by said integrating step with a predetermined discrimination reference, so that operativeness/inoperativeness of said air-fuel ratio sensor is discriminated in response to a comparison output of said comparing step; and disabling said difference calculating step, and calculating a difference in the response to an output of said output comparing step which indicates that the output signal of said air-fuel ratio sensor is below the predetermined reference level.

5. A method according to claim 4, wherein said predetermined interval of time is determined so that said air-fuel ratio sensor, when operative, changes the output signal thereof across the predetermined reference level repeatedly.

6. An apparatus for discriminating operativeness-/inoperativeness of an air-fuel ratio sensor which produces an output signal provided in an exhaust passage of an internal combustion engine so that air-fuel ratio of mixture to said engine is feedback-controlled in response to an output signal of said air-fuel ratio sensor, said apparatus comprising:

means for subtracting the output signal of said air-fuel ratio sensor from a predetermined reference level to obtain a difference therebetween;

means for integrating the difference obtained by said subtracting means during an integration interval to produce an integration value;

means for measuring said integration interval during which said integrating means integrates said difference; and means for comparing the integration value produced by said integrating means with a predetermined discrimination reference when the integration interval attains a predetermined value, so that operativeness/inoperativeness of said air-fuel ratio sensor is discriminated in response to a comparison output of said comparing means.

7. An apparatus according to claim 6 further comprising:

means for comparing the output signal of said air-fuel ratio sensor with the predetermined reference level;

means for enabling said integrating means to continue integrating the difference, in response to an output of said output signal comparing means indicative of attainment of the output signal of said air-fuel ratio sensor at the predetermined reference level; and means for disabling feedback control of the air-fuel ratio of mixture in response to the comparison output indicative of the inoperativeness of said air-fuel ratio sensor.

8. A method for discriminating operativeness/inoperativeness of an air-fuel ratio sensor which produces an output signal provided in an exhaust passage of an interval combustion engine so that air-fuel ratio of mixture to said engine is feedback-controlled in response to an output signal of the air-fuel ratio sensor, comprising the steps of:

subtracting the output signal of the air-fuel ratio sensor from a predetermined reference level to derive a difference therebetween;

integrating the difference derived in said subtracting step;

measuring an integration interval during which said integrating step continues integrating; and comparing an integration value produced during said integrating step with a predetermined discrimination reference when the measured integration interval attains a predetermined value, so that operativeness/inoperativeness of the air-fuel ratio sensor is discriminated in response to a comparison output of the comparing step.

9. A method according to claim 8, further comprising the steps of:

comparing the output signal of the air-fuel ratio sensor with the predetermined reference level;

enabling said integrating step to continue integrating the difference in response to an output of output signal comparing step indicative of attainment of the output signal of said air-fuel ratio sensor at the predetermined reference level; and disabling feedback control of the air-fuel ratio of mixture in response to the comparison output indicative of the inoperativeness of the air-fuel ratio sensor.

* * * * *